United States Patent [19]

Malik et al.

[11] Patent Number: 4,780,234

[45] Date of Patent: Oct. 25, 1988

[54] BUILT LIQUID LAUNDRY DETERGENT CONTAINING ALKYL GLYCOSIDE SURFACTANT

[75] Inventors: Arshad H. Malik; Robert S. McDaniel; Allen D. Urfer; Gail M. Howell, all of Decatur, Ill.

[73] Assignee: Staley Continental, Inc., Rolling Meadows, Ill.

[21] Appl. No.: 122,632

[22] Filed: Oct. 26, 1987

Related U.S. Application Data

[63] Continuation of Ser. No. 860,378, May 6, 1986, abandoned.

[51] Int. Cl.[4] ..... C11D 3/075; C11D 3/10

[52] U.S. Cl. ..... 252/135; 252/174.14; 252/174.17; 252/174.19; 252/174.21; 252/DIG. 14

[58] Field of Search ..... 252/135, 174.17, 174.19, 252/174.21, 174.14, DIG. 14

[56] References Cited

U.S. PATENT DOCUMENTS

| | | | |
|---|---|---|---|
| 3,721,633 | 3/1973 | Ranauto | 252/527 |
| 4,303,556 | 12/1981 | Llenadado | 252/527 |
| 4,396,520 | 8/1983 | Payne et al. | 252/89.1 |
| 4,483,779 | 11/1984 | Llenado et al. | 252/135 |
| 4,483,787 | 11/1984 | Jones et al. | 252/551 |
| 4,606,850 | 8/1986 | Malik | 252/528 |

FOREIGN PATENT DOCUMENTS 94118 11/1983 European Pat. Off. .

*Primary Examiner*—Prince E. Willis

*Attorney, Agent, or Firm*—James B. Guffey; Michael F. Campbell; J. Daniel Wood

[57] ABSTRACT

A homogeneous and single-phase liquid laundry detergent contains alkyl glycoside nonionic surfactant and a detergent builder having a water solubility at 25° C. of less than about 55 weight percent.

13 Claims, 4 Drawing Sheets

BUILT LIQUID LAUNDRY DETERGENT CONTAINING ALKYL GLYCOSIDE SURFACTANT

This application is a continuation of application Ser. No. 860,378 filed May 6, 1986 now abandoned.

FIELD OF THE INVENTION

This invention relates to liquid laundry detergents. More particularly, this invention relates to built liquid laundry detergents containing alkyl glycoside surfactant.

BACKGROUND OF THE INVENTION

A. Liquid Laundry Detergents in General

Detergents are substances used with water to remove soil from materials. Detergents are used under conditions which vary widely (e.g., type of soil, material to be cleaned, temperature and purity of water, desired physical form of detergent, etc.) and it is, therefore, not surprising that many different types of detergents are available. This invention concerns laundry detergents (sometimes called "heavy-duty" detergents) primarily formulated and used for cleaning clothes in washing machines.

All laundry detergents contain at least one surfactant. A surfactant is a substance whose molecules contain both hydrophilic and oleophilic groups. The surfactants are primarily responsible for the soil-removing properties of the laundry detergent, although other components of the detergent augment the surfactants. Surfactants are rountinely classified according to their electrostatic charge: the nonionics possess no electrostatic charge, the anionics possess a negative charge, the cationics possess a positive charge, and the amphoterics possess both positive and negative charges. When comparing the ability of a surfactant by itself to clean clothes, the nonionics generally outperform the other types of surfactants. The most common nonionic surfactants are the ethozylates, which include ethozylated alcohols, ethoxylated alkylphenols, and ethoxylated carboxylic esters.

Most laundry detergents also contain at least one builder. Builders aid the soil-removing properties of the surfactants in several ways. For example, builders help prevent the formation of insoluble soap deposits, aid in soap suspension, and help prevent the precipitation of certain calcium and magnesium salts. The most common builders are the phosphates, such as sodium tripolyphosphate (STPP), tetrasodium pyrophosphate (TSPP), tetrapotassium pyrophosphate (TKPP), and trisodium phosphate (TSP). However, the use of phosphates in detergents is banned in many parts of the U.S.A. for environmental reasons. Other types of builders include the citrates, the zeolites, the silicates and metasilicates, the polycarboxylate salts such as salts of nitrilotriacetic acid (NTA), the carbonates and bicarbonates, the phosphonates, the polymerics, and ethylenediaminetetracetic acid (EDTA) and its salts.

Laundry detergents are sold both as powders and as liquids. Although some powders are prepared by mixing together dry ingredients, the vast majority of powders are prepared by drying an aqueous slurry of ingredients (commonly known as a "crutcher mix"). Most powders contain anionic surfactants (which generally do not clean as well as the nonionics, but which are less expensive) and rather large amount of builders to improve their cleaning performance.

Liquid laundry detergents have been commercially available for many years and their popularity continues to increase, primarily because of their convenience to the customer. However, there continues to be difficulty in formulating a cost-competitive liquid laundry detergent which cleans as well as a powder. As mentioned above, most powders contain large amounts of builder to improve the cleaning performance of the surfactants. Unfortunately, many of the more effective builders have relatively low water solubilities. Furthermore, the solubility of builders decreases rapidly when most types of surfactants are added. For example, sodium carbonate is a relatively inexpensive builder and has a water solubility at 25° C. of approximately 30 weight percent. However, its solubility drops to approximately 3 weight percent (a decrease of an order of magnitude) when only 1 percent of an ethoxylated alcohol nonionic surfactant is present. And even when the builders dissolve, there is a strong tendency for the water-surfactant-builder solution to later separate into two phases. Hydrotropes such as sodium xylene sulfonate or ethanol are sometimes used to improve solubility and to reduce phase separation, but the hydrotropes are relatively expensive and contribute little or nothing themselves to the cleaning performance of the laundry detergent.

In summary, most commercially available liquid laundry detergents contain very little or no builder and compensate by using larger amounts of surfactant and by using more effective (and more expensive) surfactants such as the ethoxylates. However, in spite of all the efforts directed at formulating liquid laundry detergents, it is still true that the liquids generally cost more and clean worse than the powders. Accordingly, there is a strong demand for a built liquid laundry detergent which: (1) is stable, homogeneous, and single-phase; (2) is cost-competitive with commercially available laundry liquids and powders; and (3) cleans as well as commercially available laundry liquids and powders.

B. Alkyl Glycosides in General

In addition to the ethoxylates, another type of nonionic surfactant which has been disclosed for use in liquid laundry detergents are the alkyl glycosides. A brief reveiw of alkyl glycoside chemistry is appropriate before considering their use in liquid laundry detergents.

Monosaccharides are polyhydroxy aldehydes and polyhydroxy ketones which, when unsubstituted, have the chemical formula $C_nH_{2n}O_n$. Monosaccharides can join together, with the loss of water, to form chains of varying lengths. The length of a saccharide chain is commonly described either by added a descriptive prefix to its name or by stating the chain's "degree of polymerization" (abbreviated to "D.P."). For example, glucose (also known as dextrose) is a monosaccharide having a D.P. of one; sucrose and maltose are disaccharides having a D.P. of two; and starch and cellulose are polysaccharides having D.P.'s of 1000 or more. The term "saccharide" encompasses unsubstituted and substituted molecules of any chain length.

Glycosides are substituted saccharides in which the substituent group is attached, through an oxygen atom, to the aldehyde or ketone carbon. Accordingly, glycosides are considered acetals. As with the term "saccharide", the term "glycoside" defines neither the number nor the identity of the saccharide units in the molecule. To describe the number of saccharide units, the same methods are used as outlined above. To describe the identity of the saccharide units, it is common to modify the name of the saccharide unit by adding the ending "-side". For example, a glucoside is a glycoside having one or more glucose units and a fructoside is a glycoside having one or more fructose units.

A variety of substituent groups can be attached to the saccharide. However, for surfactant use, long-chain (i.e., 8 to 25 carbon atoms) alkyl substituent groups are most commonly employed because the resulting glycosides are highly surface-active due to the balancing of the hydrophilicity of their saccharide portions and the lipophilicity of their long-chain alkyl portions. It is also possible for oxy-alkylene groups to be attached between the saccharide and the long-chain alkyl group. For example, the compound having the following structure is a dodecyl (oxy-ethylene) glucoside of D.P.2:

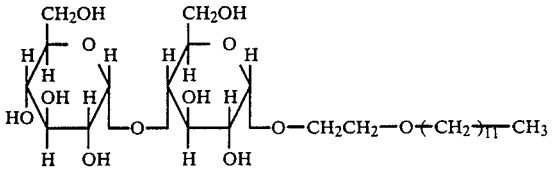

The above compound can be represented by the following formula:

$$RO-(R'O)_x-Z_y$$

where R is the dodecyl radical, R' is the ethylene radical, x is 1, Z is the glucose moiety, and y is 2.

C. Alkyl Glycosides as Surfactants and Solubilizers

A number of references have stated that alkyl glycosides are effective as surfactants in liquid laundry detergents and that alkyl glycosides exhibit solubilizing properties in certain applications. However, no known reference to date has appreciated or made use of the surprising (when compared to the ethoxylated nonionic surfactants) ability of alkyl glycosides to solubilize builders normally having low solubilities in aqueous surfactant solutions and no known reference to date has disclosed built liquid laundry detergents containing such high levels of these builders.

Ranauto, U.S. Pat. No. 3,721,633, issued Mar. 20, 1973, discloses liquid laundry detergent compositions containing alkyl glycosides and a builder selected from the group consisting of sodium nitrilotriacetate, potassium nitrilotriacetate, and potassium polyphosphate. These three builders are characterized by very high water solubilities (over 75 weight percent at 20° C.). Ranauto states that these compositions exhibit stability against phase separation without the presence of a hydrotrope. The working examples in Ranauto show compositions comprising 25 to 40 weight percent builder, 10 to 20 weight percent surfactant, and 40 to 65 weight percent water.

Kaniecki, U.S. Pat. No. 4,147,652 issued Apr. 3, 1979, discloses aqueous alkali metal hydroxide cleaning compositions. Kaniecki states that the presence of alkyl glycoside surfactants helps solubilize the alkali metal hydroxide in concentrated solutions.

Payne, U.S. Pat. No. 4,396,520, issued Aug. 2, 1983, discloses a detergent powder composition comprising: (1) an alkyl glycoside surfactant; (2) a "calcium sensitive" anionic surfactant; and (3) from 0 to about 95 percent detergent builder. Suitable detergent builders are disclosed in Llenado, U.S. Pat. No. 4,303,556, issued Dec. 1, 1981, which Payne incorporates by reference. Payne states that the alkyl glycosides "not only provide excellent detergency themselves but [also solubilize] the calcium sensitive anionic detergent cosurfactant" so that "no special processing steps or processing aids are required" in preparing the crutcher mix.

Llenado, U.S. Pat. No. 4,483,779, issued Nov. 20, 1984, discloses a detergent composition comprising: (1) an alkyl glycoside surfactant; (2) a nonionic surfactant; (3) from 0 to about 90 percent detergent builder; and (4) an anionic optical brightener.

Jones, U.S. Pat. No. 4,483,787, issued Nov. 20, 1984, discloses laundry detergent compositions containing alkyl glycoside surfactants and alkylether sulfate surfactants. Jones states that the use of the alkyl glycoside "allows the preparation of more concentrated detergent compositions containing greater percentages of detergent surfactant which dissolve readily".

Urfer, U.S. Pat. No. 4,488,981, issued Dec. 18, 1984, discloses that lower alkyl glycosides reduce the viscosity of, and prevent phase separation in, aqueous liquid detergents.

Payne, U.S. Pat. No. 4,536,319, issued Aug. 20, 1985, discloses granular laundry detergents containing alkyl glycoside surfactants. Payne states that the alkyl glycoside surfactant "permits the formation of stable crutcher mixes with lower water content so the granules can be prepared very efficiently".

SUMMARY OF THE INVENTION

The general object of this invention is to provide an improved liquid laundry detergent. A more particular object is to provide a built liquid laundry detergent which: (1) is stable, homogeneous, and single-phase; (2) is cost-competitive with commercially available laundry liquids and powders; and (3) cleans as well as commercially available laundry liquids and powders.

We have discovered a liquid laundry detergent composition which is stable, homogeneous, and single-phase at 25° C. The composition comprises:

(a) about 5 to 50 weight percent surfactant, at least 50 weight percent of which is an alkyl glycoside surfactant having the formula:

$$RO-(R'O)_x-Z_y$$

where R is a monovalent alkyl radical containing about 8 to 25 carbon atoms, O is an oxygen atom, R' is a divalent alkyl radical containing 2 to 4 carbon atoms, x is a number having an average value of 0 to about 12, Z is a reducing saccharide moiety containing 5 or 6 carbon atoms, and y is a number having an average value of about 1 to 10; and (b) a detergent builder having a water solubility at 25° C. of less than about 55 weight percent in a quantity at least equal to the greater of:

(i) 3 weight percent; and (ii) 2 times the solubility limit of the builder if, other things being equal, the alkyl glycoside were replaced by an equal weight of an ethoxylated alcohol nonionic surfactant having an average of 7 ethylene oxide units per molecule and consisting of a blend of the following alcohols: 28 weight percent dodecyl alcohol; about 36 weight percent tridecyl alcohol; about 19 weight percent tetradecyl alcohol; and about 17 weight percent pentadecyl alcohol; and (c) about 45 to 90 weight percent water.

Certain embodiments of this detergent composition are cost-competitive with commercially available detergents because they do not require the presence of a hydrotype and employ less expensive builders such as the carbonates. Yet their cleaning performance is comparable to that of commercially available laundry liquids and powders because of their relatively high level of builder.

DETAILED DESCRIPTION OF THE INVENTION

A. Surfactant

Figure 1:
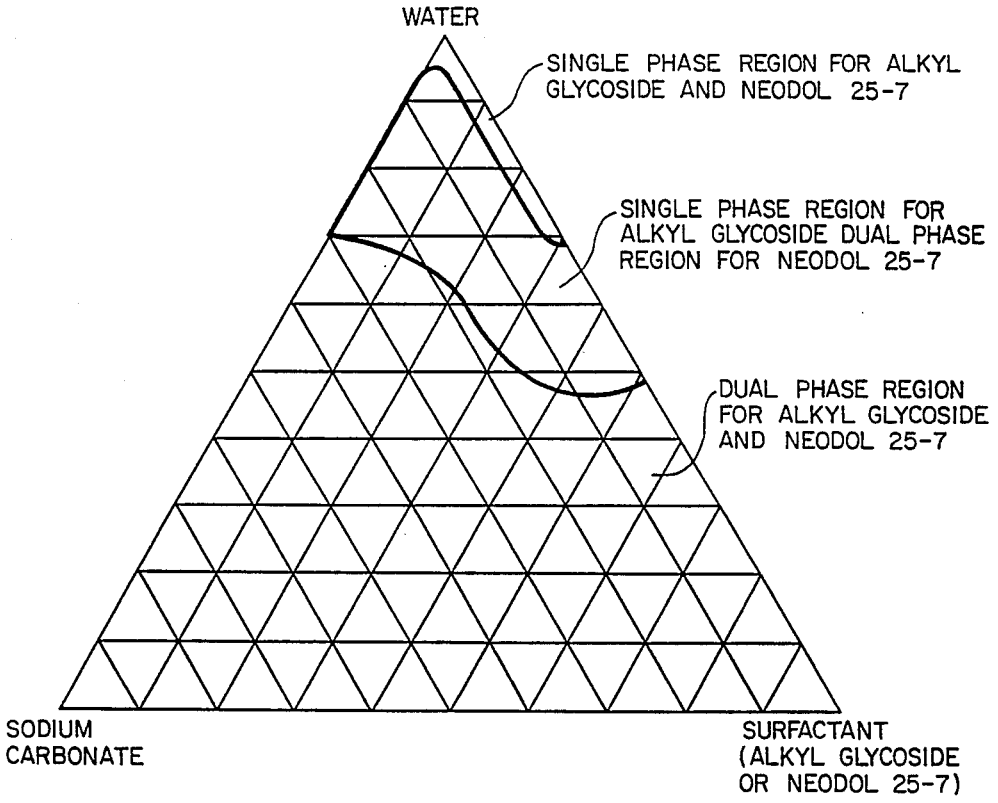
FIG. 1 is a ternary phase diagram for a water-sodium carbonate-surfactant system.

The liquid laundry detergent of this invention comprises about 5 to 50 weight percent surfactant. Surfactant concentrations of less than about 5 weight percent are generally undesirable because the resulting detergents are more dilute than detergents consumers are accustomed to using and, accordingly, greater quantities must be used for comparable cleaning. The upper limit on surfactnat concentration is imposed by solubility limits. As is shown in FIG. 1, the solubility limit of the indicated alkyl glycoside in water at 20° C. is about 50 weight percent and decreases if builder is present. The detergent preferably comprises about 10 to 40 weight percent surfactant.

Of the surfactant total, at least 50 weight percent is an alkyl glycoside surfactant as described below. Other types of nonionic surfactants clean as well as or better than the alkyl glycosides (at least in certain situations), but no other nonionic surfactant come close to the ability of the alkyl glycosides to solubilize builders. The surfactant preferably comprises at least 75 weight percent alkyl glycoside and most preferably consists essentially alkyl glycoside.

The alkyl glycoside nonionic surfactant has the formula $RO—(R')_x—Z_y$ where the letter O represents an oxygen atom and R, R', x, and y are as described below. Alkyl glycosdies are commerically available and are generally prepared by reacting a saccharide with an alcohol in the presence of an acid catalyst.

The letter R represents a monovalent alkyl radical containing about 8 to 25 carbon atoms. The term "alkyl radical" is used herein to include aliphatic, alicyclic, and aromatic organic radicals rather than being limited to paraffinic hydrocarbon radicals. In other words, the alkyl radical may be straight-chain or branches, saturated or unsaturated, and may contain carbon, hydrogen, oxygen, etc. The preferred alkyl groups are straight-chain saturated hydrocarbon radicals containing 10 to 16 carbon atoms. The most preferred alkyl radicals include the decyl, undecyl, dodecyl (also known as lauryl), tridecyl, and tetradecyl (also known as myristyl) radicals.

The letter R' represents a divalent alkyl radical containing 2 to 4 carbon atoms where the term "alkyl radical" is used as discussed above. The group (R'O) represents an oxy-alkylene repeating unit derived generally from ethylene oxide, propylene oxide, or butylene oxide. The most preferred oxy-alkylating agent is ethylene oxide because of its low cost and high reactivity. Accordingly, the preferred divalent alkyl radical is ethylene.

The letter x represents the number of oxy-alkylene units in the alkyl glycoside. The number varies from 0 to about 12. The addition of oxy-alkylene units to an alcohol prior to reaction with the saccaharide is a convenient and inexpensive way to obtain the desired chain length for the alkyl portion of the glycoside.

The letter Z represents a reducing saccharide moiety containing 5 or 6 carbon atoms. The identity of the saccharide moiety is not critical to this invention and the choice is primarily dependent upon availability. Of the 5 and 6 carbon saccharides (pentoses and hexoses), the aldoses such as glucose and ribose are generally preferred over the ketoses such as fructose and ribulose. The most preferred saccharide unit is glucose considering its ready availability from starch.

The letter y represents the number of saccharide units (D.P.) in the glycoside. This number is important because it has a strong effect on the surface activity of the glycoside. Generally, surface activity of the glycoside is maximized when the hydrophilicity of the saccharide chain balances the lipophilicity of the alkyl chain. With alkyl groups having 10 to 16 carbon atoms, the preferred average D.P. is about 1.0 to 5.0 and the most preferred average D.P. is about 1.0 to 3.0.

The identity of any non-alkyl glycoside component of the surfactant total is not critical to this invention. The selection is based primarily on cleaning performance, cost, and compatibility with other components. Illustrative surfactants are listed in Urfer, U.S. Pat. No. 4,488,981, issued Dec. 18, 1984, which is incorporated by reference.

B. Builder

The liquid laundry detergent of this invention is "built" with a detergent builder having a water solubility at 25° C. of less than about 55 weight percent. The solubilizing effects of the alkyl glycoside nonionic surfactant is most striking with these relatively low-solubility builders. Builders having solubilities greater than about 55 weight percent can be used, but there is much less incentive to use alkyl glycosides in such formulations because the builders maintain adequate solubilities even when other types of surfactants are present. Some of the more common builders, and their water solubilities, are shown in Table 1.

TABLE I

WATER SOLUBILITIES OF DETERGENT BUILDERS

| BUILDER | WATER SOLUBILITY AT 25° C. (WEIGHT PERCENT) |
|---|---|
| Potassium Nitrilotriacetate | 70 |
| Potassium Polyphosphate | 65 |
| Sodium Carbonate | 30 |
| Sodium Citrate | 45 |
| Sodium Metasilicate | 50 |
| Sodium Nitrilotriacetate | 55 |
| Sodium Tripolyphosphate | 15 |

The list of builders in Table 1 is not meant to be exhaustive and builders suitable for use in this invention include members of the phosphates, the citrates, the zeolites, the silicates and metasilicates, the polycarboxylate salts, the carbonates and bicarbonates, the phosphonates, the polymerics, and ethylenediaminetetracetic acid (EDTA) and its salts. The identity of the builder preferred for a given application is a matter of choice and depends on a variety of factors. For example. sodium tripolyphosphate (STPP) is very effective, but is less soluble than other builders and is banned for environmental reasons in many parts of the U.S.A. In contrast, sodium carbonate is not as effective as STPP, but is less expensive, more soluble, and environmentally safe.

The builder is present in a quantity at least equal to the greater of: (a) 3 weight percent; and (b) 2 times the solubility limit of the builder if, other things being equal, the alkyl glycoside were replaced by a "benchmark" linear alcohol ethoxylate (LAE). The benchmark LAE contains an average of 7 ethylene oxide units per molecule and consists of a blend of the following alcohols: about 28 weight percent dodecyl alcohol; about 36 weight percent tridecyl alcohol; about 19 weight percent tetradecyl alcohol; and about 17 weight percent pentadecyl alcohol. This benchmark is chosen because it is the current chemical composition of Neodel 25-7 surfactant, a commercial produce of the Shell Chemical Company and an industry standard. The 3 weight percent "floor" in the formula applies primarily to situations where the solubility limit of the benchmark LAE in the builder-free system has been exceeded.

The computations of builder quantity using the above formula can be illustrated using the following example. In FIG. 1, the solubility limit of sodium carbonate at 10 weight percent Neodol 25-7 in the ternary system is about 3 weight percent. Accordingly, the detergent of this invention containing 10 weight percent surfactant comprises at least about 6 weight percent sodium carbonate. If the surfactant is pure alkyl glycoside, the builder concentration ranges from 6 weight percent up to about 22 weight percent (the solubility limit of sodium carbonate in a 10 weight percent alkyl glycoside aqueous solution). The builder is generally present in a quantity at least 3.0 times its solubility limit with the benchmark linear alcohol ethoxylate and is sometimes present in a quantity, 5, 6, 7, or more times its solubility limit with the alcohol.

C. Other Ingredients

In addition to surfactant and builder, the liquid laundry detergent of this invention also comprises about 45 to 90, preferably about 60 to 80, weight percent water. The water is present in sufficient quantity so that the detergent is homogeneous and single-phase. Greater amounts of water are undesirable because they add to shipping costs and result in an overly dilute detergent requiring excessive amounts to be used to achieve an acceptable level of cleaning.

Ingredients which may or may not be present include hydrotropes, perfumes, fillers, anti-redeposition agents, corrosino inhibitors, pH adjusters or buffers, dyes or clorings, optical brighteners, foam control agents, bleaches, opacifiers, stabilizers, etc. Hydrotropes such as sodium xylene sulfonate and ethanol are not harmful but are simply unnecessary because of the solubilizing effect of the alkyl glycosides. The preferred detergent is essentially free of hydrotropes.

D. Examples

These examples are illustrative only.

EXAMPLE 1

This Example illustrates that an alkyl glycoside surfactant is superior to a linear alcohol ethoxylate ("LAE") nonionic surfactant in its ability to solubilize two common builders.

The alkyl glycoside surfactant was a dodecyl glucoside having an average D.P. of about 1 to 3. The LAE surfactant was Neodol 25-7 surfactant, a commercial product of the Shell Chemical Company whose chemical composition is described above.

Phase diagrams of the water-builder-surfactant system were prepared for two builders, sodium carbonate and sodium citrate, with each of the two surfactants.

The formulations were prepared by adding the surfactant to water and then added the builder. The formulations were then shaken vigorously by hand and allowed to settle for about 8 hours, after which they were examined for the presence or absence of two phases. All the work was done at room temperature, i.e., about 25° C.

Figure 2:
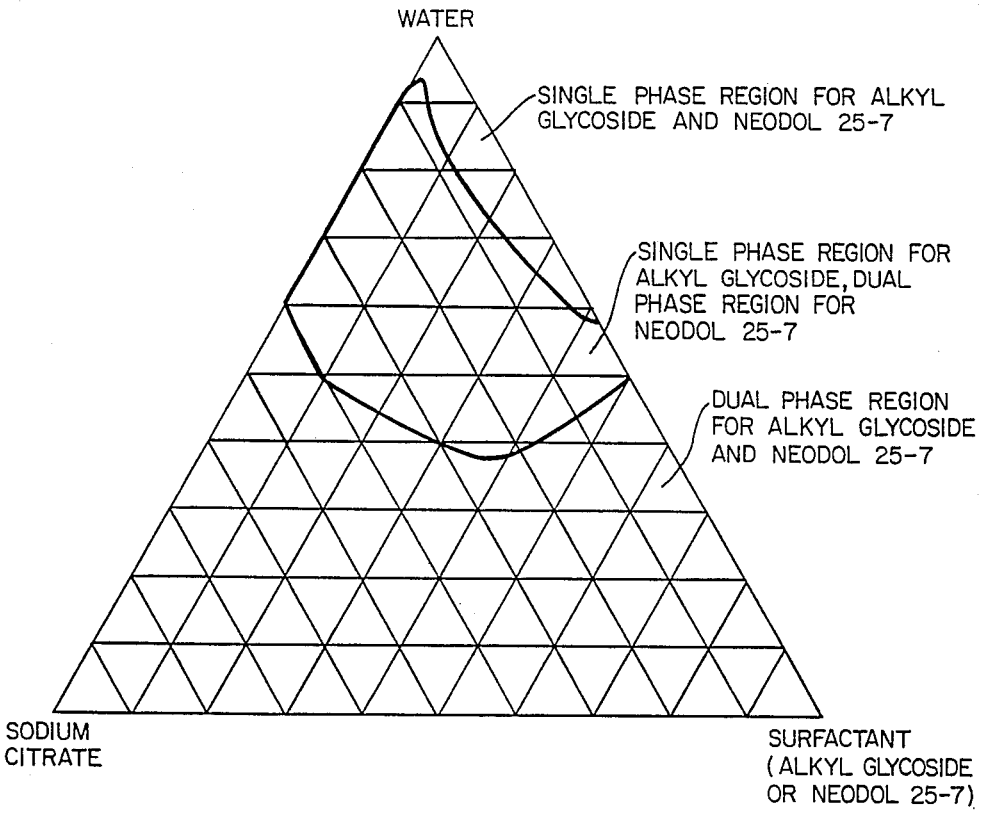
FIG. 2 is a ternary phase diagram for a water-sodium citrate-surfactant system.

The results are shown in FIGS. 1 and 2. With each builder, it can be seen that the single-phase region for the alkyl glycoside surfactant is considerably larger than the single-phase region for the LAE surfactant.

EXAMPLE 2

This Example illustrates that an alkyl glycoside is superior to a nonyl phenol ethoxylate nonionic surfactant in its ability to solubilize two common builders.

The nonyl phenol ethoxylate surfactant was Igepal CO-630 surfactant, a commercial product of the General Aniline & Film Corporation, which contains an average of 9.5 ethylene oxide units per molecule. The two builders were sodium tripolyphosphate (STPP) and sodium metasilicate. In all other respects, the procedure of Example 1 was repeated.

Figure 3:
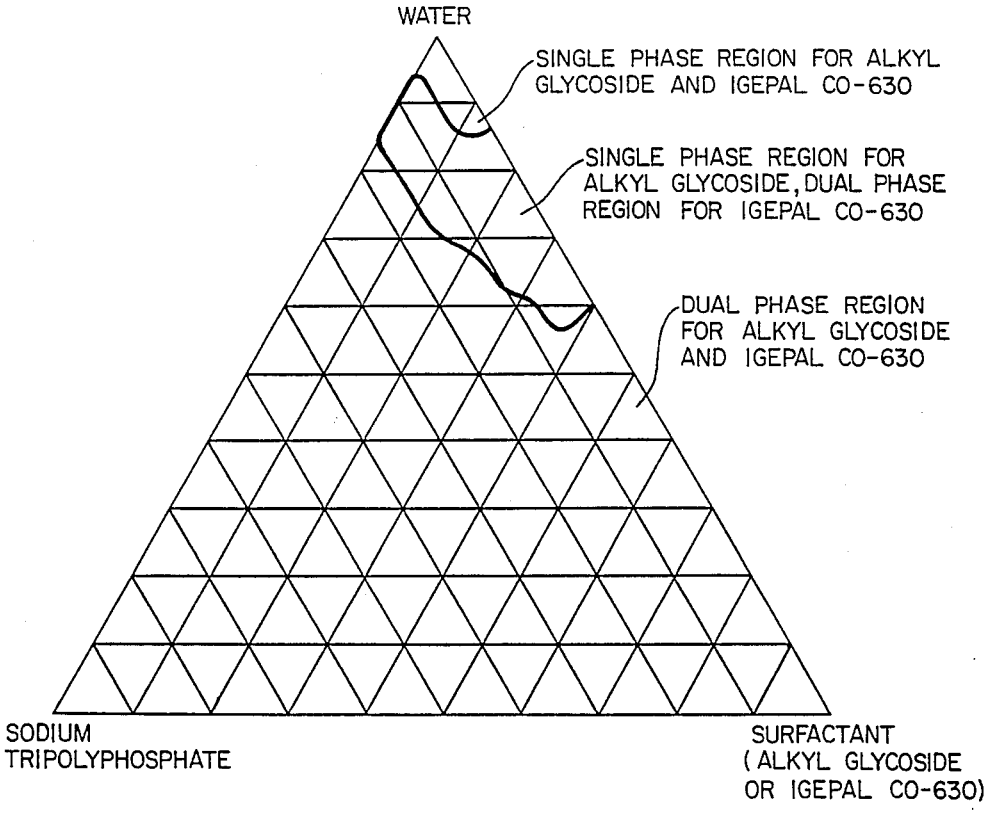
FIG. 3 is a ternary phase diagram for a water-sodium tripolyphosphate-surfactant system.
Figure 4:
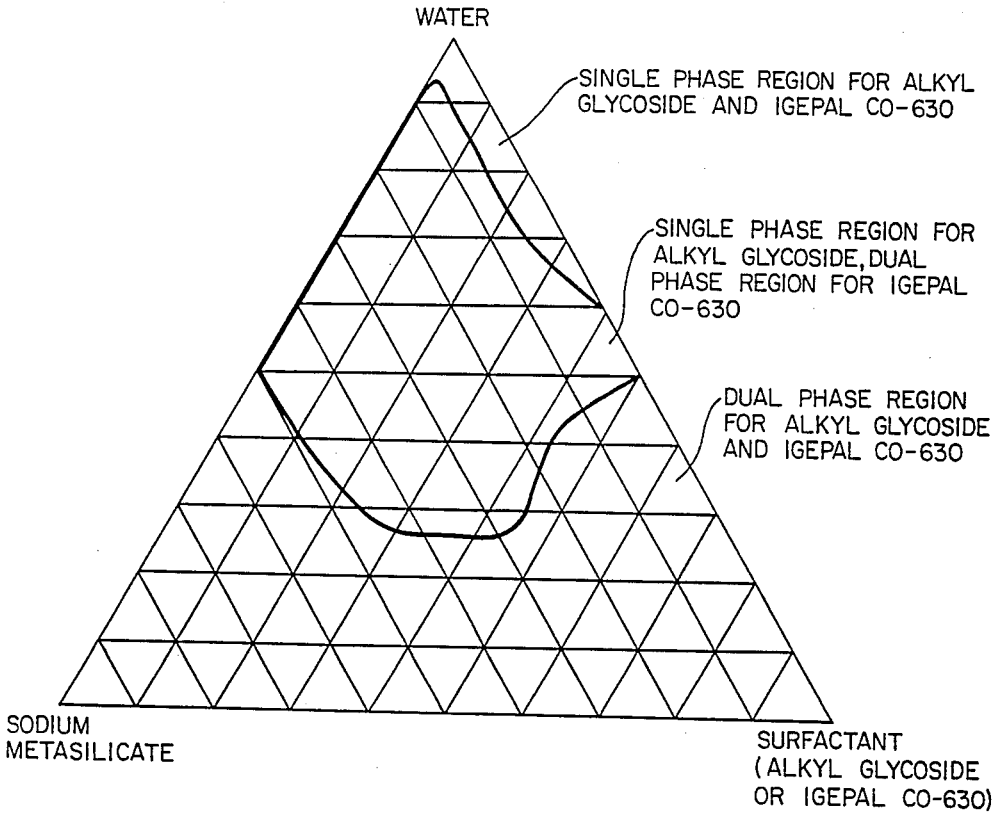
FIG. 4 is a ternary phase diagram for a water-sodium metasilicate-surfactant system.

The results are shown in FIGS. 3 and 4. With each builder, it can be seen that the single-phase region for the alkyl glycoside surfactant is considerably larger than the single-phase region for the nonyl phenol ethoxylate surfactant.

EXAMPLE 3

This Example illustrates that the fabric cleaning properties of the built liquid laundry detergent of this invention is comparable to that of commercially-available liquid laundry detergents.

Five liquid laundry detergents were tested for their ability to clean soiled cloths made of cotton and of a 65–35 blend of dacron and cotton.

The first detergent contained 20 weight percent alkyl glycoside surfactant, 10 weight percent sodium carbonate, and the balance water. The alkyl glycoside was dodecyl glucoside having an average D.P. of about 1 to 3.

The second detergent was Wisk liquid laundry detergent, a commercial product of Lever Brothers Company, New York, N.Y.

The third detergent was Era liquid laundry detergent, a commercial produce of Proctor & Gamble Company, Cincinnati, Ohio.

The fourth detergent was Dutch liquid laundry detergent, a commercial produce of Purex Corporation, Lakewood, Calif.

The fifth detergent was Amway liquid laundry detergent, a commercial product of Amway Corporation, Ada, Mich.

The cotton and dacron/cotton soiled cloths used were Spangler Dust-Sebum Cloths, which are commerical products of the Scientific Services Company, Oakland, N.J. The dimensions of the cloths were approximately 9 cm×10 cm.

The wash water was 120 ppm synthetic hard water (the hardness calculated as calcium carbonate) containing 0.88 g detergent per liter.

The testing procedure was as follows: The light reflectance of a soiled cloth was measured on a Hunter Laboratories Lab-Scan Colorimeter. Reflectance values were read on the "L" scale using an ultraviolet filter and a 2° C. light source.

One liter of wash water was placed into a Model 1243 Tergotometer, a product of United States Testing Co., Inc. Hoboken, N.J., and heated to 42° C. The soiled cloth was added and the washing was conducted at 125 rpm for 15 minutes. After the washing, the cloth was rinsed with room temperature tap water, wrung, dried in a commercial laundry dryer, and then ironed to remove wrinkles.

The reflectance of the washed cloth was then measured as before. The difference in the before and after reflectance values is an indication of the cleaning properties of the surfactant.

The results are present below in Table II.

TABLE II

DELTA REFLECTANCE VALUES FOR DETERGENTS

| DETERGENT | COTTON | DACRON/ COTTON |
|---|---|---|
| Dodecyl glucoside-sodium carbonate | 8.1 | 12.1 |
| Wisk | 12.9 | 16.9 |
| ERA | 12.3 | 16.6 |
| Dutch | 9.1 | 10.8 |
| Amway | 11.6 | 11.3 |

We claim:

1. A liquid laundry detergent composition which is essentially free of hydrotropes and is homogeneous and single-phase at 25° C. and which comprises:

(a) about 5 to 50 weight percent surfactant, at least 50 weight percent of which is an alkyl glycoside surfactant having the formula:

$$RO—(R'O)_x—Z_y$$

where R is a monovalent alkyl radical containing about 8 to 25 carbon atoms, O is an oxygen atom, R' if a divalent alkyl radical containing 2 to 4 carbon atoms, x is a number having an average value of 0 to about 12, Z is a reducing saccharide moiety containing 5 or 6 carbon atoms, and y is a number having an average value of about 1 to 10;

(b) a detergent builder consisting essentially of builders selected from the group consisting of sodium tripolyphosphate, alkali metal carbonates, alkali metal citrates, and alkali metal metasilicates; said detergent builder being present in a quantity at least equal to the greater of:

(i) 3 weight percent; or (ii) 2 times the solubility limit of such builder in a corresponding benchmark composition wherein the alkyl glycoside surfactant has been replaced by an equal weight of an ethoxylated alcohol nonionic surfactant having an average of 7 ethylene oxide units per molecule and consisting of a blend of the following alcohols: about 28 weight percent dodecyl alcohol; about 36 weight percent tridecyl alcohol; about 19 weight percent tetradecyl alcohol; and about 17 weight percent pentadecyl alcohol; and (c) about 45 to 90 weight percent water.

2. The detergent composition of claim 1 wherein the alkyl glycoside surfactant comprises at least 75 weight percent of the surfactant.

3. The detergent composition of claim 1 wherein the surfactant component of such composition consists essentially of the alkyl glycoside surfactant.

4. The detergent composition of claim 1 wherein the detergent builder is sodium carbonate and wherein the sodium carbonate constitutes at least about 6 weight percent of said detergent composition.

5. The detergent composition of claim 3 wherein the alkyl glycoside surfactant has the formula:

$$RO—Z_y$$

where R is a monovalent, straight chain, saturated alkyl radical containing 10 to 16 carbon atoms, O is an oxygen atom, Z is a glucoside moiety, and y is a number having an average value of about 1.0 to 3.0.

6. The detergent composition of claim 5 wherein the detergent comprises about 10 to 40 weight percent surfactant.

7. The detergent composition of claim 1 wherein the detergent builder is present in a quantity at least equal to 3.0 times the solubility limit of said builder in the indicated benchmark composition.

8. The detergent composition of claim 1 wherein the detergent builder is selected from the group consisting of sodium tripolyphosphate, sodium carbonate, sodium citrate, and sodium metasilicate.

9. The detergent composition of claim 1 wherein the detergent builder is sodium tripolyphosphate.

10. The detergent composition of claim 1 wherein the detergent builder is sodium carbonate.

11. The detergent composition of claim 1 wherein the detergent builder is sodium carbonate and wherein the sodium carbonate constitutes at least about 6 weight percent of said detergent composition.

12. The detergent composition of claim 1 wherein the detergent builder is sodium citrate.

13. The detergent composition of claim 1 wherein the detergent builder is sodium metasilicate.

* * * * *